US011610548B2

(12) United States Patent
Xu et al.

(10) Patent No.: US 11,610,548 B2
(45) Date of Patent: Mar. 21, 2023

(54) METHOD, A DEVICE, A DISPLAY DEVICE AND A MEDIUM FOR IMPROVING OLED RESIDUAL IMAGES

(71) Applicants: Chengdu BOE Optoelectronics Technology Co., Ltd., Sichuan (CN); BOE TECHNOLOGY GROUP CO., LTD., Beijing (CN)

(72) Inventors: Biao Xu, Beijing (CN); Pohsien Wu, Beijing (CN); Shuang Zhao, Beijing (CN)

(73) Assignees: Chengdu BOE Optoelectronics Technology Co., Ltd., Chengdu (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/487,928

(22) Filed: Sep. 28, 2021

(65) Prior Publication Data

US 2022/0230589 A1 Jul. 21, 2022

(30) Foreign Application Priority Data

Jan. 21, 2021 (CN) ..... 202110083853.6

(51) Int. Cl.
*G09G 3/3258* (2016.01)

(52) U.S. Cl.
CPC ... *G09G 3/3258* (2013.01); *G09G 2320/0271* (2013.01); *G09G 2320/0276* (2013.01);
(Continued)

(58) Field of Classification Search
CPC ..... G09G 3/3258; G09G 2320/041; G09G 2320/043; G09G 2320/045;
(Continued)

(56) References Cited

U.S. PATENT DOCUMENTS 5,914,629 A 6/1999 Maki
11,062,675 B2 * 7/2021 Leerentveld ..... G09G 3/3233
(Continued)

FOREIGN PATENT DOCUMENTS

CN 103165076 A 6/2013
CN 104318893 A 1/2015
(Continued)

OTHER PUBLICATIONS

"First Office Action and English language translation", CN Application No. 202110083853.6, dated Sep. 15, 2021, 26 pp.

*Primary Examiner* — Tom V Sheng
(74) *Attorney, Agent, or Firm* — Myers Bigel, P.A.

(57) ABSTRACT

The present application discloses a method, a device, a display device and a medium for improving OLED residual images. The method for improving OLED residual images includes obtaining a life attenuation rate relationship and a life attenuation degree relationship of an OLED display panel, dividing a display area of the display panel into a plurality of sub-areas to monitor temperature change and gray scale change of each sub-area respectively, obtaining a temperature value and a gray scale value of each sub-area at a current moment, calculating a current life attenuation rate according to the temperature value and the gray scale value, and calculating a current luminous time of each sub-area, calculating a life attenuation degree of each sub-area according to the current luminous time of each sub-area, and performing pixel compensation to each sub-area respectively according to the current life attenuation degree of each sub-area.

16 Claims, 4 Drawing Sheets

(52) U.S. Cl.
CPC ..... *G09G 2320/0295* (2013.01); *G09G 2320/041* (2013.01); *G09G 2320/043* (2013.01); *G09G 2320/045* (2013.01); *G09G 2320/048* (2013.01); *G09G 2320/0693* (2013.01)

(58) Field of Classification Search
CPC ..... G09G 2320/048; G09G 2320/0271; G09G 2320/0276; G09G 2320/0295; G09G 2320/0693
USPC ..... 345/204
See application file for complete search history.

(56) References Cited

U.S. PATENT DOCUMENTS

| | | | | |
|---|---|---|---|---|
| 2010/0265228 | A1* | 10/2010 | Kimura | G09G 3/3233 345/207 |
| 2013/0147693 | A1 | 6/2013 | Bae | |
| 2016/0366747 | A1 | 12/2016 | Han et al. | |
| 2017/0124943 | A1* | 5/2017 | Peana | G09G 3/3225 |
| 2017/0206836 | A1* | 7/2017 | Kim | G09G 3/3233 |
| 2017/0213493 | A1 | 7/2017 | Han | |
| 2019/0213949 | A1 | 7/2019 | Han | |
| 2020/0027393 | A1* | 1/2020 | Tang | G09G 3/3225 |
| 2020/0027394 | A1* | 1/2020 | Tang | G09G 3/3233 |
| 2020/0243043 | A1* | 7/2020 | Leerentveld | G09G 3/3233 |
| 2020/0265779 | A1 | 8/2020 | In | |
| 2020/0286414 | A1 | 9/2020 | Kim et al. | |
| 2020/0349884 | A1 | 11/2020 | Lai et al. | |
| 2020/0357336 | A1* | 11/2020 | Xu | G09G 3/3233 |
| 2020/0388204 | A1 | 12/2020 | Holsteen et al. | |

FOREIGN PATENT DOCUMENTS

| | | | |
|---|---|---|---|
| CN | 104505029 | A | 4/2015 |
| CN | 107103881 | A | 8/2017 |
| CN | 110689588 | A | 1/2020 |
| CN | 110751923 | A | 2/2020 |
| CN | 111354287 | A | 6/2020 |
| CN | 111599310 | A | 8/2020 |
| CN | 111754935 | A | 10/2020 |

* cited by examiner

METHOD, A DEVICE, A DISPLAY DEVICE AND A MEDIUM FOR IMPROVING OLED RESIDUAL IMAGES

RELATED APPLICATION

The present application claims the benefit of the Chinese Patent Application No. 202110083853.6 filed on Jan. 21, 2021, the entire disclosures of which are incorporated herein by reference.

FIELD

The present application generally relates to the technical field of display devices, particularly to a method, a device, a display device and a medium for improving OLED residual images.

BACKGROUND

Organic light emitting diodes (OLED) have been widely used in displays because of its characteristics of self-luminous, high brightness, wide viewing angle, rapid response and RGB full-color components can be produced, etc. However, there is a serious problem in OLED display products, that is, after long-term use, due to the inconsistent life attenuation of organic material R/G/B of light-emitting layer in OLED devices, the image displayed on the display has color deviation and image sticking.

Due to the IC distribution and circuit design of an OLED panel, during the working process of the panel, its temperature is much higher than that of normal temperature, and the distribution is uneven. The temperature near the IC side is high and the temperature away from the IC side is relatively low. Therefore, the temperature of the sub-pixel on the OLED panel near the IC side is high, and its life presents a trend of faster accelerated attenuation. After a long time, the high and low temperature on both sides cause accelerated separation of life attenuation of sub-pixels in different areas, resulting in more serious color deviation and excessive brightness difference in the display image.

SUMMARY

In view of the above defects or shortcomings in the prior art, it is desired to provide a method, a device, a display device and a medium for improving OLED residual images, which can perform different adjustments to each area according to the life attenuation degree of sub-pixels in different areas, so as to improve color deviation and image sticking of the OLED display panel.

In a first aspect, the present application provides a method for improving OLED residual images, comprising:

obtaining a life attenuation rate relationship and a life attenuation degree relationship of an OLED display panel;

dividing a display area of the display panel into a plurality of sub-areas to monitor temperature change and gray scale change of each sub-area respectively;

obtaining a temperature value and a gray scale value of each sub-area at a current moment, calculating a current life attenuation rate according to the temperature value and the gray scale value, and calculating a current luminous time of each sub-area;

calculating a life attenuation degree of each sub-area according to the current luminous time of each sub-area;

performing pixel compensation to each sub-area respectively according to the current life attenuation degree of each sub-area.

In one embodiment, the life attenuation rate relationship includes a gray scale attenuation rate relationship and a temperature attenuation rate relationship; and the life attenuation degree relationship is a relationship between a brightness attenuation degree and a luminous time.

In one embodiment, the gray scale attenuation rate relationship is a proportional relationship between a life attenuation rate under a current gray scale value and a life attenuation rate under a basic gray scale value; the temperature attenuation rate relationship is a proportional relationship between a life attenuation rate under a current temperature value and a life attenuation rate under a basic temperature value.

In one embodiment, the step of obtaining a life attenuation relationship of an OLED display panel comprises:

performing life attenuation test to OLED display devices in a same batch of a production line to obtain a life attenuation relationship of the OLED display panel.

In one embodiment, the step of calculating a current life attenuation rate according to the temperature value and the gray scale value comprises:

bringing the temperature value into the temperature attenuation rate relationship to obtain a first life attenuation rate proportion under a current temperature value;

bringing the gray scale value into the gray scale attenuation rate relationship to obtain a second life attenuation rate proportion under a current gray scale value;

calculating a current life attenuation rate proportion, the current life attenuation rate proportion=the first life attenuation rate proportion×the second life attenuation rate proportion.

In one embodiment, the current luminous time is an equivalent luminous time under the basic gray scale value and the basic temperature value, i.e., the current luminous time=an actual luminous time×the current life attenuation rate proportion.

In one embodiment, the step of calculating a life attenuation degree of each sub-area according to the current luminous time of each sub-area comprises:

accumulating the current luminous time to obtain a current accumulative luminous time;

bringing the current accumulative luminous time into the life attenuation degree relationship to calculate a current life attenuation degree.

In one embodiment, the step of performing pixel compensation to each sub-area respectively according to the current life attenuation degree of each sub-area comprises:

determining, based on a gamma value and a current life attenuation value of the display panel, a gray scale compensation parameter so as to perform gray scale compensation to pixels of each sub-area respectively.

In a second aspect, the present application provides a device for improving OLED residual images for carrying out a method for improving OLED residual images as mentioned above, the device comprising:

a life attenuation test module for performing a life attenuation test to an OLED display device so as to obtain a life attenuation relationship of an OLED display panel;

a temperature obtaining module for, arranged on a plurality of sub-areas of the display area, obtaining a temperature value of each sub-area respectively;

a gray scale obtaining module for, arranged on a plurality of sub-areas of the display area, obtaining a gray scale value of each sub-area respectively;

a calculating module for calculating a current life attenuation value of each sub-area according to the temperature value, the gray scale value and the life attenuation relationship;

a timing module for obtaining the temperature value and gray scale value at a predetermined time interval and accumulating the current luminous time;

a compensating module for compensating pixels based on the current life attenuation value.

In a third aspect, the present application provides an OLED display device, comprising: a display panel, a plurality of temperature sensors integrated in the display panel, a processor, wherein the processor is use for:

dividing a display area of the display panel into a plurality of sub-areas to monitor temperature change and gray scale change of each sub-area respectively;

obtaining a temperature value and a gray scale value of each sub-area at a current moment, calculating a current life attenuation rate according to the temperature value and the gray scale value, and calculating a current luminous time of each sub-area;

calculating a life attenuation degree of each sub-area according to the current luminous time of each sub-area;

performing pixel compensation to each sub-area respectively according to the current life attenuation degree of each sub-area.

In one embodiment, every N1*N2 sub-pixels on the display panel are grouped into a sub-area, each sub-area is provided with a temperature sensor;

the temperature sensor comprises a plurality of transistor groups arranged in parallel, the transistor group comprises a plurality of transistors arranged in series; in one of the transistor groups, a first pole of a transistor is electrically connected with a second pole of an adjacent transistor, a first end and a second end of the transistor group are electrically connected with a controller respectively; a gate of the transistor is electrically connected with a gate signal line.

In one embodiment, the transistor is arranged for, in response to control of the gate signal line, generating a driving current on a conduction path between the first end and the second end of the transistor group;

the controller is arranged for inputting voltages at the first end and the second end of the transistor group at intervals; the controller is further arranged for obtaining an electric current at the first end or the second end of the transistor group.

In one embodiment, the processor being arranged for obtaining a temperature value of each sub-area at a current moment comprises:

calculating a temperature change of the sub-area according to an electric current change of the plurality of transistor groups.

In one embodiment, a length-width ratio of the transistor is set to 5/30.

In one embodiment, the processor being arranged for performing pixel compensation to each sub-area respectively according to the current life attenuation degree of each sub-area comprises:

obtaining a current life attenuation degree of each sub-area;

determining, according to the current life attenuation value, a gray scale compensation parameter of each sub-pixel in the sub-area;

performing pixel compensation to each sub-pixel according to the gray scale compensation parameter.

In one embodiment, the gray scale compensation parameter is a voltage signal to be outputted currently at the sub-pixel position.

In a fourth aspect, the present application provides a computer storage medium storing computer executable instructions for, when run by a computer, causing the computer to carry out the method for improving OLED residual images as mentioned above.

The technical solutions provided by the embodiments of the present application may include the following beneficial effects:

The method for improving OLED residual images provided by the embodiments of the present application divides the display area into a plurality of sub-areas, respectively monitors a temperature change and a gray scale change of different sub-areas, calculates a attenuation degree of sub-pixels in different sub-areas, and then compensates each sub-area respectively, so as to achieve the same brightness at different positions of the panel, and effectively improve the problems of color deviation and image sticking of display images after long-term use of display products.

DETAILED DESCRIPTION OF THE DRAWINGS

By reading the detailed description on the non-limiting embodiments with reference to the following drawings, other features, purposes and advantages of the present application will become more obvious:

EMBODIMENTS

Figure 1:
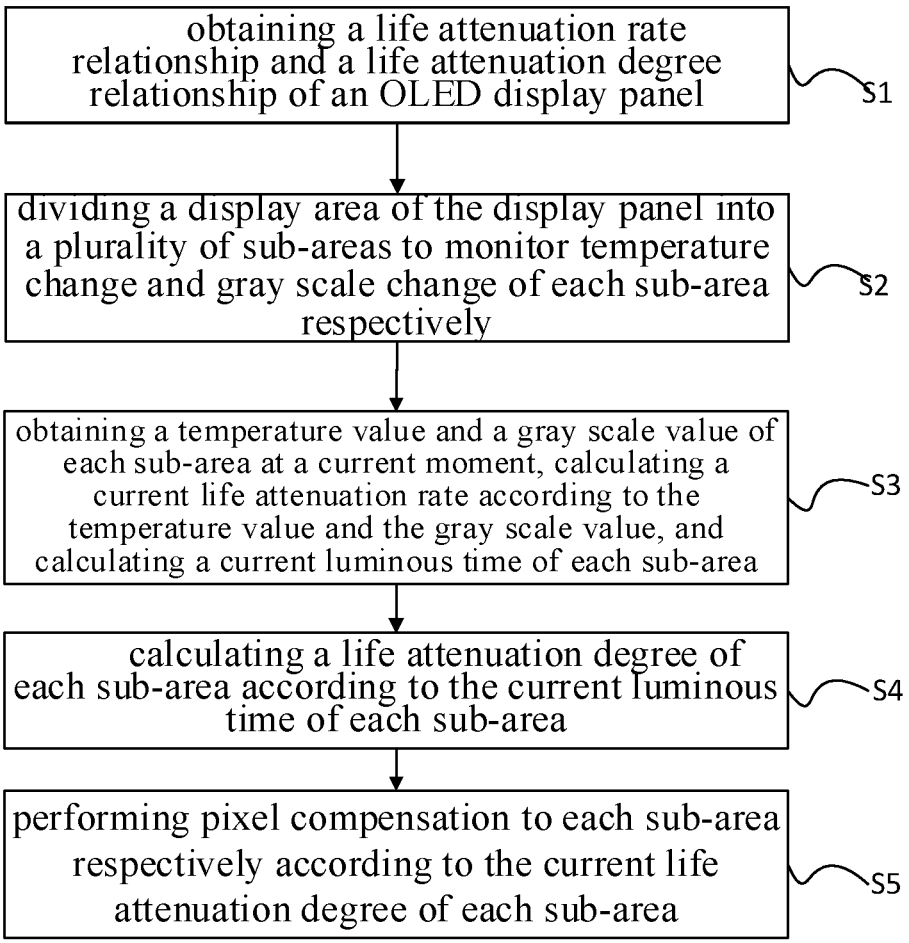
FIG. 1 is a flow chart of a method for improving OLED residual images according to an embodiment of the present application.

The present application will be further described in detail below in combination with the accompanying drawings and embodiments. It can be understood that the specific embodiments described herein are only used to explain the present application but not to limit the present application. In addition, it should be noted that for the convenience of description, only parts related to the present application are shown in the drawings.

It should be noted that the embodiments in the present application and the features in the embodiments can be combined with each other without conflict. The present application will be described in detail below with reference to the accompanying drawings and in combination with the embodiments.

Please refer to FIG. 1 for details, the present application provides a method for improving OLED residual images, comprising:

S1, obtaining a life attenuation rate relationship and a life attenuation degree relationship of an OLED display panel;

S2, dividing a display area of the display panel into a plurality of sub-areas to monitor temperature change and gray scale change of each sub-area respectively;

S3, obtaining a temperature value and a gray scale value of each sub-area at a current moment, calculating a current life attenuation rate according to the temperature value and the gray scale value, and calculating a current luminous time of each sub-area;

S4, calculating a life attenuation degree of each sub-area according to the current luminous time of each sub-area;

S5, performing pixel compensation to each sub-area respectively according to the current life attenuation degree of each sub-area.

At step S1, the life attenuation rate relationship includes a gray scale attenuation rate relationship and a temperature attenuation rate relationship; and the life attenuation degree relationship is a relationship between a brightness attenuation degree and a luminous time. The gray scale attenuation rate relationship is a proportional relationship between a life attenuation rate under a current gray scale value and a life attenuation rate under a basic gray scale value; the temperature attenuation rate relationship is a proportional relationship between a life attenuation rate under a current temperature value and a life attenuation rate under a basic temperature value. The life attenuation degree relationship is a relationship between a brightness attenuation degree and a luminous time. In the process of using the display panel, due to the influence of pixel aging and attenuation, the luminous brightness of pixels will decrease with the increase of luminous time.

In specific setting, the step of obtaining a life attenuation relationship of an OLED display panel comprises:

performing life attenuation test to OLED display devices in a same batch of a production line to obtain a life attenuation relationship of the OLED display panel.

It should be noted that as long as the structure and the organic light-emitting material of the OLED device are not changed, its service life is considered to be the same in specific implementation. As long as there is no change in structural materials and production lines among different batches, the life is also considered to be the same. The life of the same organic light-emitting material located at different positions of the display area is the same, and there is no difference.

Figure 2:
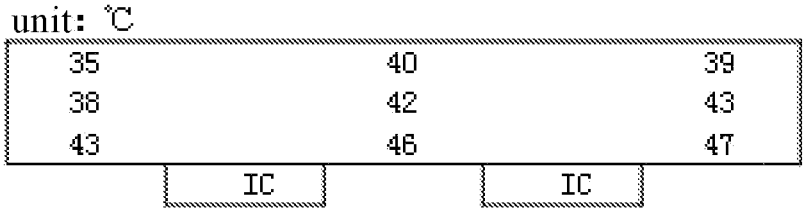
FIG. 2 is a schematic view of temperature distribution on an OLED display panel according to an embodiment of the present application.

It should also be noted that the aging and attenuation degree of pixels in OLED device is not only related to the life of the organic light-emitting material, but also related to the temperature and display gray scale of the display area. FIG. 2 shows the temperature distribution at different positions of the OLED display area. Therefore, the aging and attenuation degree of pixels in each area of the display panel is different, so that the degree of reduction of luminous brightness of different pixels is also different, resulting in the phenomenon of display residual image, which will reduce the display effect of the display panel, shorten the service life of the display panel and affect the user experience.

Figure 3:
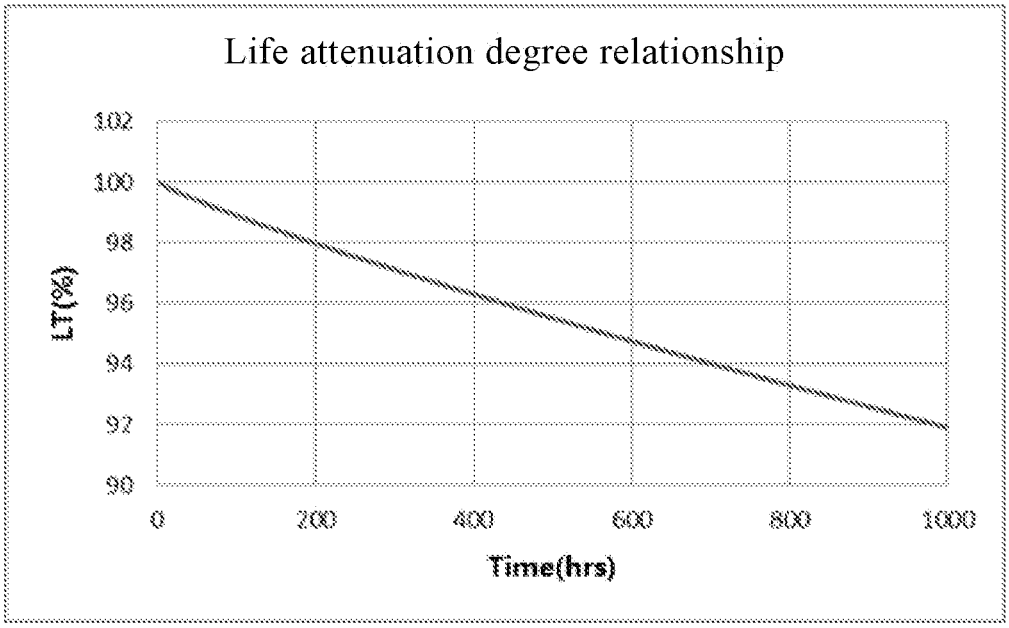
FIG. 3 is a schematic view of a life attenuation degree relationship of an OLED according to an embodiment of the present application.

At least three relationships are obtained by performing life attenuation test to OLED display devices in a same batch of a production line:

The first is the relationship between the brightness attenuation degree of the organic light-emitting material and the luminous time. As shown in FIG. 3, the horizontal coordinate represents the luminous time, and the longitudinal coordinate represents the normalized relative brightness. The luminous brightness of pixels not affected by pixel aging is set to 1. As can be seen from FIG. 3, the luminous brightness of the display panel decreases with the increase of the luminous time.

It should be noted that there are three kinds of RGB organic materials in OLED. The life attenuation of the RGB organic materials is inconsistent. The attenuation rate of the blue organic material is the fastest ($LT(R) \geq LT(G) >> LT(B)$), the life attenuation of the green organic material is faster, and the life attenuation of the red organic material is slower.

In addition, it should be noted that the test data selects a basic gray scale value and a basic temperature value as the reference, performs test and obtains the life attenuation data under the basic gray scale value and the basic temperature value. It should be noted that the life attenuation of the organic light-emitting materials is different at different service temperatures and for displaying different gray scales. Therefore, when calculating the life of different sub-areas, it is necessary to unify the life calculation standards.

In specific implementation, it can be tested separately according to different organic materials. For example, each monochrome light-emitting device in the OLED display panel can be selected as the aging experimental object to perform life attenuation curve test respectively. Of course, the comprehensive life of an OLED can be considered and the light-emitting devices in the OLED can be taken as the test object. In the embodiment of the present application, only the life attenuation curve of green organic material is selected as an example. The life data of OLED green organic light emitting devices is as shown in Table 1 below.

| $L/L_0$ | t |
|---|---|
| 100% | 0 |
| 99% | 88 |
| 98% | 196 |
| 97% | 312 |
| 96% | 436 |
| 95% | 566 |

It should be noted that the above method for improving OLED residual images according to the embodiment of the present application can be applied to a full-color OLED display panel containing monochrome light-emitting devices of various colors, and the color of monochrome light-emitting devices is not limited here.

Figure 4:
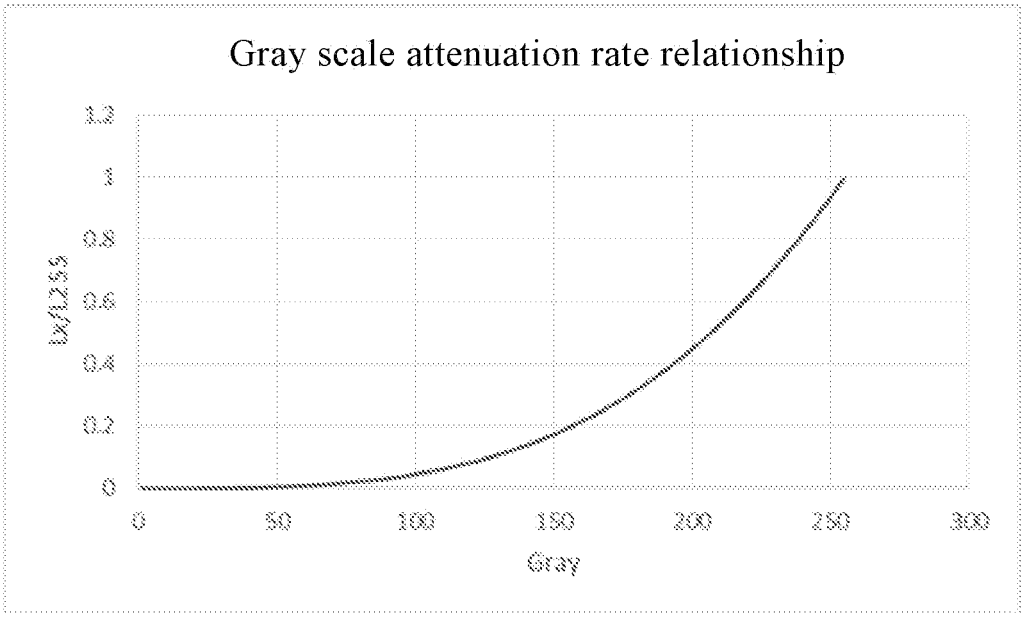
FIG. 4 is a schematic view of a gray scale attenuation rate relationship of an OLED according to an embodiment of the present application.

The second is the gray scale attenuation rate relationship, as shown in FIG. 4. The horizontal coordinate is the gray scale value, and the longitudinal coordinate is the ratio of the attenuation rate of the gray scale value to the gray scale value of 255. For example, in the gray scale relationship, L207/L255=0.5 means that at a certain moment, the gray scale value of 207 is attenuated by 50% of the gray scale value of 255 at that moment. For example, in combination with FIG. 4 and Table 1, the gray scale value of 255 attenuates to 99% at 88 h, that is, it attenuates by 1%, so it is considered that lighting 88 h at the gray scale value of 207 is equivalent to lighting 44 h at the gray scale value of 255.

For example, the effective gray scale value range can be 0~255, and the gray scale value of 255 is selected as the basic gray scale value. It should be noted that the gray scale value of 255 is the maximum gray scale value in the commonly used effective gray scale value range of 0~255. It can be understood that, compared with other gray-scale values, the gray-scale attenuation rate of the sub-pixel is the largest when the sub-pixel is lit in the case of the gray-scale value of 255, and then when the gray-scale value of 255 is used as the basic gray-scale value, the equivalent lighting time value obtained from the actual lighting time of the sub-pixel is small, which is conducive to simplifying the storage difficulty of time data and reducing the calculation difficulty of time data.

Figure 5:
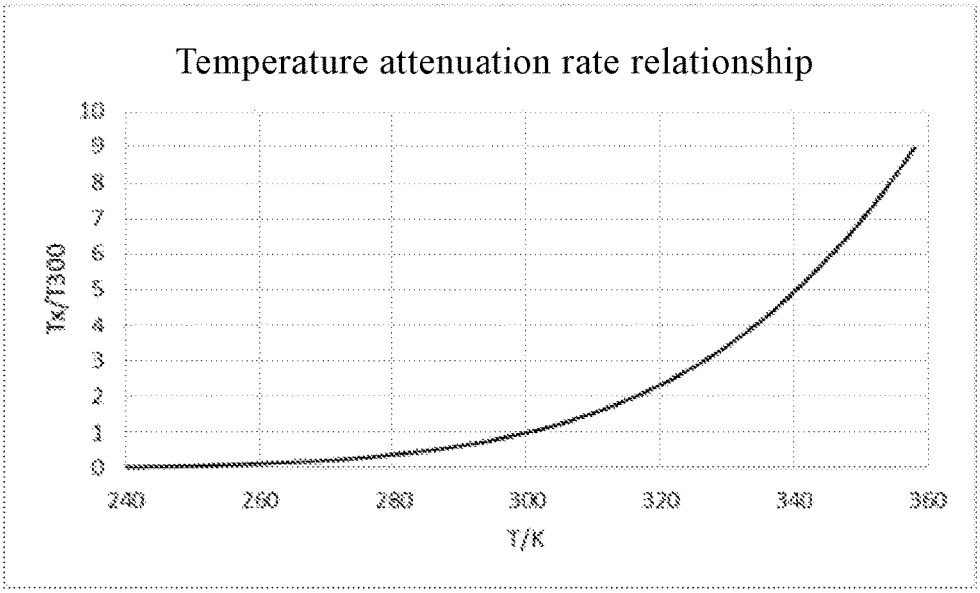
FIG. 5 is a schematic view of a temperature attenuation rate relationship of an OLED according to an embodiment of the present application.
Figure 6:
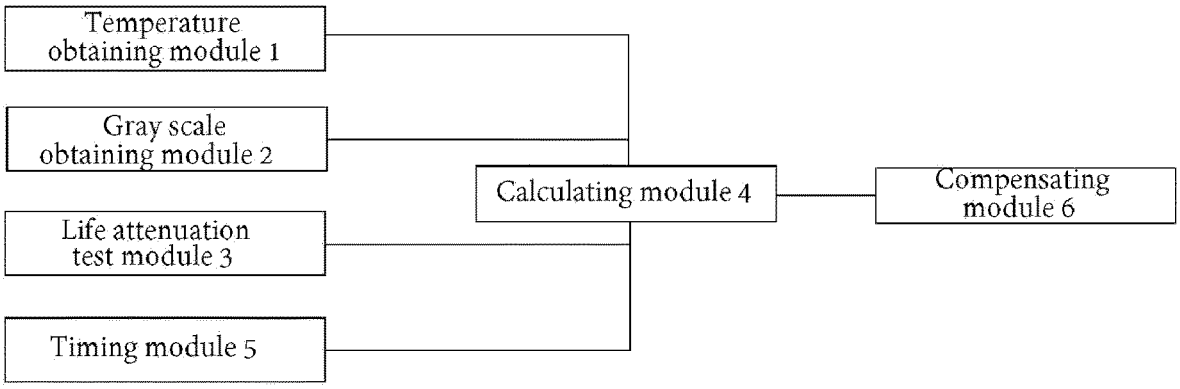
FIG. 6 is a schematic view of a device for improving OLED residual images according to an embodiment of the present application.

The third is the temperature attenuation rate relationship, as shown in FIG. 5. The horizontal coordinate is the temperature value, and the longitudinal coordinate is the ratio of the attenuation rate of the temperature value to the temperature value of 300K. In specific test, the attenuation rate of the temperature value of 300K is selected as the basic pixel attenuation rate. For example, in the temperature relationship, T316K/T300K=2 represents that the temperature value of 316K at a certain moment is attenuated by twice the pixel attenuation rate of the temperature value of 300K at that moment. For example, in combination with FIG. 5 and Table 1, if the temperature value of 300K is attenuated to 99% at 88 h, that is, it is attenuated by 1%, it is considered that lighting 88 h at the temperature value of 316K is equivalent to lighting 176 h at the temperature value of 300K.

It should be noted that in the embodiment of the present application, 300K is selected as the basic temperature value. During the aging experiment, other temperatures can also be selected as the basic temperature value, and the corresponding curve can be obtained as the temperature attenuation rate relationship. In the specific embodiment, it can be selected according to the properties of the organic light-emitting material used by the OLED.

At step S3, the step of calculating a current life attenuation rate according to the temperature value and the gray scale value comprises:

bringing the temperature value into the temperature attenuation rate relationship to obtain a first life attenuation rate proportion under a current temperature value;

bringing the gray scale value into the gray scale attenuation rate relationship to obtain a second life attenuation rate proportion under a current gray scale value;

calculating a current life attenuation rate proportion, the current life attenuation rate proportion=the first life attenuation rate proportion×the second life attenuation rate proportion.

At step S3, the current luminous time is an equivalent luminous time under the basic gray scale value and the basic temperature value, i.e., the current luminous time=an actual luminous time×the current life attenuation rate proportion.

At step S4, the step of calculating a life attenuation degree of each sub-area according to the current luminous time of each sub-area comprises:

accumulating the current luminous time to obtain a current accumulative luminous time;

bringing the current accumulative luminous time into the life attenuation degree relationship to calculate a current life attenuation degree.

In the specific implementation, the sampling period can also be set to regularly calculate the attenuation degree data of sub-pixels in different areas on the display panel, and use the latest calculated attenuation degree data to update the data in the memory. For example, when the sampling period is set to 0.5 seconds and the pixels on the display panel are displayed for 0.5 seconds, the aging and attenuation degree data of the pixels will be determined according to the method of determining the pixel attenuation degree as described above, and the data will be stored in the memory. After displaying for 1 second, the above process of determining the aging and attenuation degree of pixels will be carried out again, and new attenuation degree data of pixels will be obtained. At this time, the aging and attenuation degree data can be used to update the attenuation degree data in the memory.

For example, the temperature and gray-scale data are detected every 0.5 s. At a certain moment in a sub-area, it is detected that the temperature value is 316K (the second life attenuation rate proportion is 2), the gray-scale value is 207 (the first life attenuation rate proportion is 0.5), and the actual luminous time is 5 s (current luminous time=5*0.5*2=5 s). When detecting at a certain moment, it is detected that the temperature value is 316K (the second life attenuation rate proportion is 2), the gray scale value is 130 (the first life attenuation rate proportion is 0.1), and the actual luminous time is 5 s (current luminous time=5*0.1*2=1 s). Therefore, the current accumulative luminous time=(the last accumulative luminous time+5 s+1 s).

The current brightness attenuation degree can be obtained by bringing the current accumulative luminous time into the life attenuation degree relationship, i.e., the relationship between brightness attenuation degree and luminous time, obtained in step S1. For example, when the accumulative luminous time is 88 h, the attenuation degree reaches 1%.

At step S5, the step of performing pixel compensation to each sub-area respectively according to the current life attenuation degree of each sub-area comprises: determining, based on a gamma value and a current life attenuation value of the display panel, a gray scale compensation parameter so as to perform gray scale compensation to pixels of each sub-area respectively.

The TFT (thin film field effect transistor) irradiates the pixel with an external light source, and uses the pixel to control the transmittance T of luminous energy to determine the brightness and darkness of the pixel. As the proportional relationship between input signal and output brightness, the gamma curve plays an important role in the display effect of display device. As an index of output brightness, the transmittance T is mainly controlled by the applied voltage, wherein the applied voltage is namely the input signal. Therefore, once the OLED display device is produced, there is a fixed transmittance T, that is, a fixed gamma curve.

In the embodiment of the present application, it can be set as needed to perform pixel compensation at a fixed attenuation degree (such as 50% attenuation or other attenuation degrees). Of course, other compensation conditions can also be set, such as taking the current accumulative luminous time as the compensation condition, and pixel compensation can be performed at the set time point. In the specific implementation, different settings are made according to different needs.

It should also be noted that the pixel compensation method, in addition to the examples in the embodiments of the present application, can also be realized in other ways, such as performing pixel compensation by compensating the brightness, so as to achieve the purpose of improving the color deviation and image sticking of the OLED display panel.

Based on the same inventive concept, an embodiment of the present application further provides a device for improving OLED residual images for carrying out a method for improving OLED residual images as mentioned above, the device comprising:

a temperature obtaining module 1 for, arranged on a plurality of sub-areas of the display area, obtaining a temperature value of each sub-area respectively;

a gray scale obtaining module 2 for, arranged on a plurality of sub-areas of the display area, obtaining a gray scale value of each sub-area respectively;

a life attenuation test module 3 for performing a life attenuation test to an OLED display device so as to obtain a life attenuation relationship of an OLED display panel;

a calculating module 4 for calculating a current life attenuation value of each sub-area according to the temperature value, the gray scale value and the life attenuation relationship;

a timing module 5 for obtaining the temperature value and gray scale value at a predetermined time interval and accumulating the current luminous time;

a compensating module 6 for compensating pixels based on the current life attenuation value It can be understood by those ordinary skilled in the art that the above functional modules can be implemented as software, firmware, hardware and appropriate combinations thereof. In the hardware implementation, the division between the above functional modules does not necessarily correspond to the division of physical components. For example, a physical component may have multiple functions of the gray-scale obtaining module 2, the life attenuation test module 3, the calculating module 4, the timing module 5 and the compensating module 6, or a functional module may be executed jointly by several physical components. Some or all physical components may be implemented as software executed by a processor, such as a central processing unit, a digital signal processor, or a microprocessor, or as hardware, or as an integrated circuit, such as an application specific integrated circuit.

An embodiment of the present application further provides an OLED display device, comprising: a display panel, a plurality of temperature sensors integrated in the display panel, a processor, wherein the processor is use for:

dividing a display area of the display panel into a plurality of sub-areas to monitor temperature change and gray scale change of each sub-area respectively;

obtaining a temperature value and a gray scale value of each sub-area at a current moment, calculating a current life attenuation rate according to the temperature value and the gray scale value, and calculating a current luminous time of each sub-area;

calculating a life attenuation degree of each sub-area according to the current luminous time of each sub-area;

performing pixel compensation to each sub-area respectively according to the current life attenuation degree of each sub-area.

In the specific implementation, every N1*N2 sub-pixels on the display panel can be grouped into a sub-area, and each sub-area is provided with a temperature sensor.

The temperature sensor comprises a plurality of transistor groups arranged in parallel, each of the transistor groups comprises a plurality of transistors arranged in series. In one of the transistor groups, a first pole of a transistor is electrically connected with a second pole of an adjacent transistor. A first end and a second end of the transistor group are electrically connected with a controller respectively. A gate of the transistor is electrically connected with a gate signal line.

The transistor is arranged for, in response to control of the gate signal line, generating a driving current on a conduction path between the first end and the second end of the transistor group.

The controller is arranged for inputting voltages at the first end and the second end of the transistor group at intervals; the controller is further arranged for obtaining an electric current at the first end or the second end of the transistor group.

The processor being arranged for obtaining a temperature value of each sub-area at a current moment comprises: calculating a temperature change of the sub-area according to an electric current change of the plurality of transistor groups.

In the specific implementation, the processor being arranged for performing pixel compensation to each sub-area respectively according to the current life attenuation degree of each sub-area comprises:

obtaining a current life attenuation degree of each sub-area;

determining, according to the current life attenuation value, a gray scale compensation parameter of each sub-pixel in the sub-area;

performing pixel compensation to each sub-pixel according to the gray scale compensation parameter.

The gray scale compensation parameter is a voltage signal to be outputted currently at the sub-pixel position.

Figure 7:
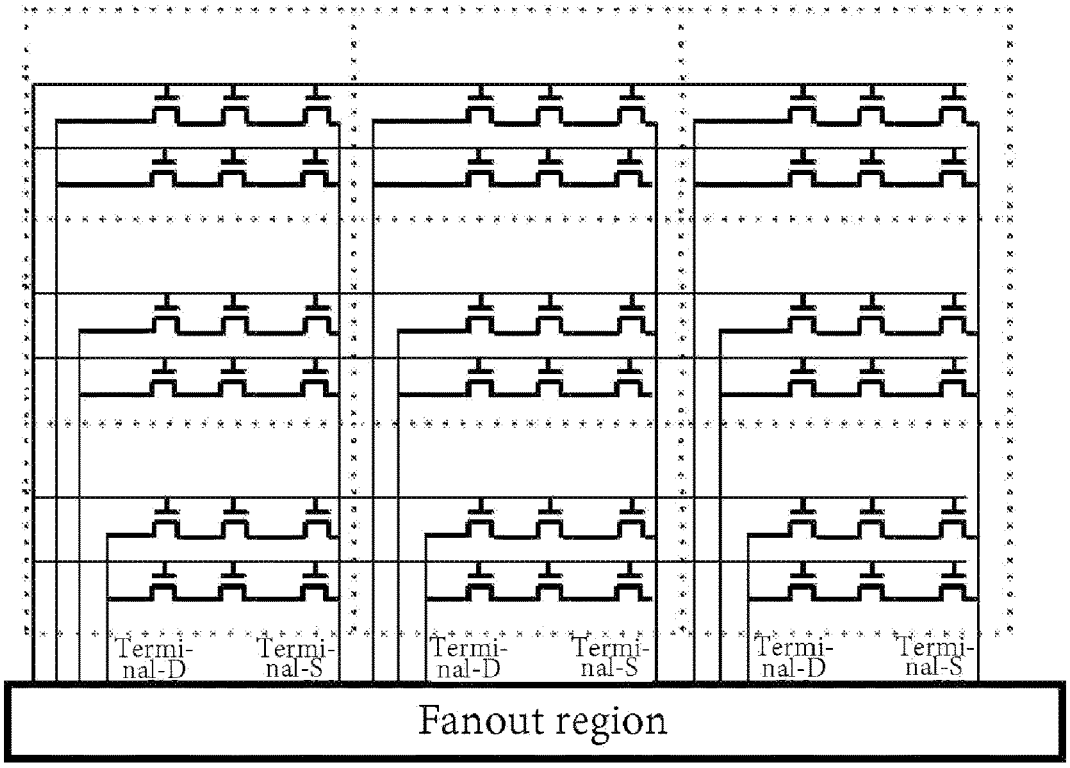
FIG. 7 is a TFT temperature sensor distribution diagram according to an embodiment of the present application.

FIG. 7 shows a TFT temperature sensor distribution diagram. The dotted line in the figure represents the AA area of the panel. It is assumed that it is divided into 9 areas (during specific setting, different segmentation can be carried out according to the actual situation). Separately controlled TFT temperature sensors are arranged in the 9 areas to monitor the temperature of each area. A plurality of TFTs connected in series can be arranged respectively in a certain area to reduce the process error of a single TFT device. Then, multiple groups of TFTs connected in series are connected in parallel in order to increase the total current and increase the detection sensitivity.

Figure 8:
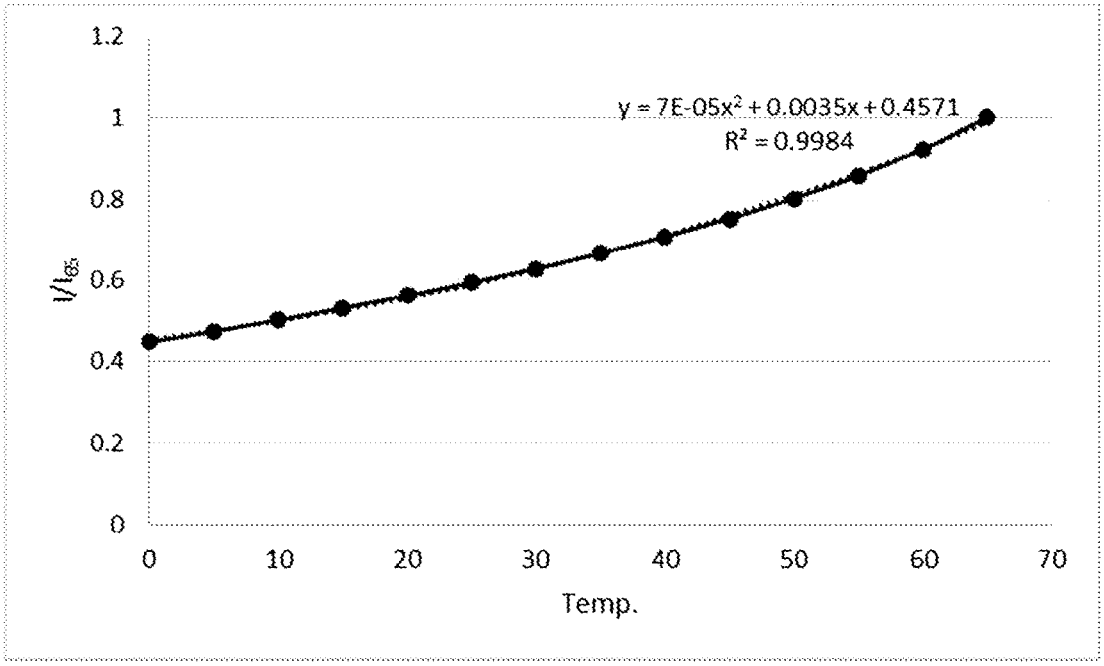
FIG. 8 is a schematic view of TFT current variation at different temperatures in a saturation region according to an embodiment of the present application.

In the embodiment of the application, the TFT current variation at different temperatures in the simulated saturation region as shown in FIG. 8 is obtained by simulating the TFT temperature sensors. With the increase of temperature, the TFT current in the saturation region shows an upward trend. The simulated source (S-terminal) voltage is 2V, the drain (D-terminal) voltage is −3V, the gate voltage is 0V, and the threshold voltage Vth of TFT is −1V. The fitting formula with temperature variation trend is obtained as follows: $y=(7E-05)\ x^2+0.0035x+0.4571$.

Further, the temperature obtaining module 1 also includes a voltage input controller connected with the drain and the source of the transistor so that the voltages of the source and the drain are input at intervals.

When the display panel starts working, the gray scale and line difference at different positions cause different temperatures. By applying a 3V voltage to the S terminal (source) and a −2V voltage to the D terminal (drain) of the TFT temperature sensors in 9 areas, and applying a −7V low level to scanning lines of the TFT temperature sensors, the gate is opened and the current flowing through the D terminal is detected. The S-terminal and D-terminal voltages can be input at intervals. Assume that the interval input is set every 1 minute (as required), the impact of this TFT on other OLED circuits can be reduced.

In specific preparation, in the process of preparing 7T1C pixel circuit, the TFT temperature sensor is prepared synchronously, and the preparation process is the same. A TFT temperature sensor is prepared every 5*5 (or 10*10) sub-pixels as required, and the length-width ratio of the TFT is set to 5/30 (set as required). A TFT temperature sensor is prepared by every 5*5 sub-pixels, which will not have a great impact on the pixel layout and SD wiring, and the method is convenient and simple.

It should be noted that the OLED display panel may include a processor, a memory, an input/output device, etc. The input device may include a keyboard, a mouse, a touch screen etc. The output device may include a display device, such as a liquid crystal display (LCD), a cathode ray tube (CRT) etc.

The processor can be a central processing unit (CPU), or other general-purpose processor, digital signal processor (DSP), application specific integrated circuit (ASIC), field programmable gate array (FPGA) or other programmable logic devices, discrete gate or transistor logic devices, discrete hardware components, etc. The general-purpose processor can be a microprocessor or any conventional processor. The processor is the control center of the OLED display panel, and various interfaces and lines are used to connect various parts of the whole OLED display panel.

The memory can be used to store computer programs and/or modules, and the processor realizes various functions of the computer device by running or executing computer programs and/or modules stored in the memory and calling data stored in the memory. The memory can mainly include a storage program area and a storage data area, wherein the storage program area can store an operating system, an application program required for at least one function (such as a sound playback function, an image playback function, etc.). In addition, the memory may include high-speed random access memory, and may also include nonvolatile memory, such as hard disk, internal memory, plug-in hard disk, smart media card (SMC), secure digital (SD) card, flash card, at least one disk storage device, flash memory device, or other volatile solid-state storage devices.

Based on the same inventive concept, an embodiment of the present invention provides a computer storage medium for storing computer executable instructions for, when run by a computer, causing the computer to carry out the method for improving OLED residual images as mentioned above.

Those skilled in the art should appreciate that embodiments of the present application may provide methods, systems, or computer program products. Therefore, the present application may take the form of a complete hardware embodiment, a complete software embodiment, or an embodiment combining software and hardware. Moreover, the present application may take the form of a computer program product implemented on one or more computer usable storage media (including but not limited to disk memory, CD-ROM, optical memory, etc.) containing computer executable program codes.

The present application is described with reference to flow charts and/or block diagrams of methods, devices (systems), and computer program products according to various embodiments of the present application. It should be understood that each process and/or block in the flowchart and/or block diagram and the combination of processes and/or blocks in the flowchart and/or block diagram can be realized by computer program instructions. These computer program instructions can be provided to the processor of a general-purpose computer, a special-purpose computer, an embedded processor or other programmable data processing devices to generate a machine, so as to enable the instructions executed by a processor of a computer or other programmable data processing devices to generate means for implementing functions specified in one or more processes of the flowchart and/or one or more blocks of the block diagram.

These computer program instructions may also be stored in a computer-readable memory capable of guiding a computer or other programmable data processing devices to work in a specific manner, so that the instructions stored in the computer-readable memory generate a manufacturing product including an instruction device, which instruction device implements the functions specified in one or more processes of the flowchart and/or one or more blocks of the block diagram.

These computer program instructions can also be loaded on a computer or other programmable data processing devices so that a series of operation steps are performed on the computer or other programmable devices to produce computer implemented processing, thus, instructions executed on a computer or other programmable devices provide steps for implementing the functions specified in one or more processes of the flowchart and/or one or more blocks of the block diagram.

It should be understood that the azimuth or positional relationship indicated by the terms "length", "width", "upper", "lower", "front", "rear", "left", "right", "vertical", "horizontal", "top", "bottom", "inner", "outer" and so on is based on the azimuth or positional relationship shown in the accompanying drawings, only for the convenience of describing the invention and simplifying the description, rather than indicating or implying that the device or element must have a specific orientation, be constructed and operated in a specific orientation, it cannot be understood as a limitation of the present invention.

In addition, the terms "first" and "second" are only used for descriptive purposes and cannot be understood as indicating or implying relative importance or implicitly indicating the number of indicated technical features. Thus, the features defined by "first" and "second" may explicitly or implicitly include one or more of the features. In the description of the application, "multiple" means two or more, unless otherwise specifically defined.

Unless otherwise defined, the technical and scientific terms used in this disclosure have the same meanings as those generally understood by those skilled in the technical field of the present application. The terms used in this disclosure are only for describing specific implementation purposes and are not intended to limit the present application. Terms such as "arrange" appearing in this disclosure can mean that one part is directly attached to another part or that one part is attached to another part through a middleware. The features described in one embodiment of this disclosure may be applied to another embodiment alone or in combination with other features, unless the features are not applicable in the other embodiment or otherwise described.

The present application has been described through the above embodiments, but it should be understood that the above embodiments are only for the purpose of illustrations, and are not intended to limit the present application to the scope of the described embodiments. It can be understood by those skilled in the art that a variety of modifications and amendments can be made according to the teaching of the present application, and these modifications and amendments fall within the scope of protection claimed in the present application.

The invention claimed is:

1. A method for improving OLED residual images, comprising:

obtaining a life attenuation rate relationship and a life attenuation degree relationship of an OLED display panel, wherein the life attenuation rate relationship includes a gray scale attenuation rate relationship and a temperature attenuation rate relationship; and the life attenuation degree relationship is a relationship between a brightness attenuation degree and a luminous time;

dividing a display area of the OLED display panel into a plurality of sub-areas to monitor temperature change and gray scale change of each sub-area respectively;

obtaining a temperature value and a gray scale value of each sub-area at a current moment, calculating a current life attenuation rate according to the temperature value and the gray scale value, and calculating a current luminous time of each sub-area, wherein the current luminous time is an equivalent luminous time under a basic gray scale value and a basic temperature value;

calculating a current life attenuation degree of each sub-area according to the current luminous time of each sub-area; and performing pixel compensation to each sub-area respectively according to the current life attenuation degree of each sub-area.

2. The method for improving OLED residual images according to claim 1, wherein the gray scale attenuation rate relationship is a proportional relationship between a life attenuation rate under a current gray scale value and a life attenuation rate under the basic gray scale value, and wherein the temperature attenuation rate relationship is a proportional relationship between a life attenuation rate under a current temperature value and a life attenuation rate under the basic temperature value.

3. The method for improving OLED residual images according to claim 2, wherein the calculating a current life attenuation rate according to the temperature value and the gray scale value comprises:

bringing the temperature value into the temperature attenuation rate relationship to obtain a first life attenuation rate proportion under a current temperature value;

bringing the gray scale value into the gray scale attenuation rate relationship to obtain a second life attenuation rate proportion under a current gray scale value; and calculating a current life attenuation rate proportion, wherein the current life attenuation rate proportion=the first life attenuation rate proportion×the second life attenuation rate proportion.

4. The method for improving OLED residual images according to claim 3, wherein the current luminous time=an actual luminous time×the current life attenuation rate proportion.

5. The method for improving OLED residual images according to claim 1, wherein the obtaining a life attenuation relationship of an OLED display panel comprises:

performing life attenuation test to OLED display devices in a same batch of a production line to obtain a life attenuation relationship of the OLED display panel.

6. The method for improving OLED residual images according to claim 1, wherein the calculating a current life attenuation degree of each sub-area according to the current luminous time of each sub-area comprises:

accumulating the current luminous time to obtain a current accumulative luminous time; and bringing the current accumulative luminous time into the life attenuation degree relationship to calculate the current life attenuation degree.

7. The method for improving OLED residual images according to claim 1, wherein the performing pixel compensation to each sub-area respectively according to the current life attenuation degree of each sub-area comprises:

determining, based on a gamma value and a current life attenuation value of the OLED display panel, a gray scale compensation parameter so as to perform gray scale compensation to pixels of each sub-area respectively.

8. A device for improving OLED residual images for carrying out a method for improving OLED residual images as claimed in claim 1, the device comprising:

a life attenuation test module configured to perform a life attenuation test to an OLED display device so as to obtain a life attenuation relationship of an OLED display panel;

a temperature obtaining module, arranged on a plurality of sub-areas of the display area, configured to obtain a temperature value of each sub-area respectively;

a gray scale obtaining module, arranged on a plurality of sub-areas of the display area, configured to obtain a gray scale value of each sub-area respectively;

a calculating module configured to calculate a current life attenuation value of each sub-area according to the temperature value, the gray scale value and the life attenuation relationship;

a timing module configured to obtain the temperature value and gray scale value at a predetermined time interval and accumulating the current luminous time; and a compensating module configured to compensate pixels based on the current life attenuation value.

9. A non-transitory computer storage medium storing computer executable instructions for, when run by a computer, causing the computer to carry out the method for improving OLED residual images according to claim 1.

10. An OLED display device, comprising:

a display panel;

a plurality of temperature sensors integrated in the display panel; and a processor, wherein the processor is configured to perform operations comprising:

dividing a display area of the display panel into a plurality of sub-areas to monitor temperature change and gray scale change of each sub-area respectively;

obtaining a temperature value and a gray scale value of each sub-area at a current moment, calculating a current life attenuation rate according to the temperature value and the gray scale value, and calculating a current luminous time of each sub-area, wherein the current luminous time is an equivalent luminous time under a basic gray scale value and a basic temperature value;

calculating a current life attenuation degree of each sub-area according to the current luminous time of each sub-area; and performing pixel compensation to each sub-area respectively according to the current life attenuation degree of each sub-area.

11. The OLED display device according to claim 10, wherein every N1*N2 sub-pixels on the display panel are grouped into a sub-area, and each sub-area is provided with a temperature sensor, wherein the temperature sensor comprises a plurality of transistor groups arranged in parallel, each transistor group comprises a plurality of transistors arranged in series, wherein in one of the transistor groups, a first pole of a transistor is electrically connected with a second pole of an adjacent transistor, a first end and a second end of the of the one of the transistor groups are electrically connected with a controller respectively, and wherein a gate of the transistor is electrically connected with a gate signal line.

12. The OLED display device according to claim 11, wherein the transistor, in response to control of the gate signal line, is configured to generate a driving current on a conduction path between the first end and the second end of the transistor group, wherein the controller is configured to input voltages at the first end and the second end of the transistor group at intervals, and wherein the controller is further configured to obtain an electric current at the first end or the second end of the transistor group.

13. The OLED display device according to claim 11, wherein the obtaining a temperature value of each sub-area at a current moment comprises:

calculating a temperature change of the sub-area according to an electric current change of the plurality of transistor groups.

14. The OLED display device according to claim 11, wherein a length-width ratio of the transistor is set to 5/30.

15. The OLED display device according to claim 10, wherein the performing pixel compensation to each sub-area respectively according to the current life attenuation degree of each sub-area comprises:

obtaining the current life attenuation degree of each sub-area;

determining, according to the current life attenuation degree, a gray scale compensation parameter of each sub-pixel in the sub-area; and performing pixel compensation to each sub-pixel according to the gray scale compensation parameter.

16. The OLED display device according to claim 15, wherein the gray scale compensation parameter is a voltage signal to be outputted currently at a sub-pixel position.

* * * * *